US005218784A

United States Patent [19]

Pollock

[11] Patent Number: 5,218,784

[45] Date of Patent: Jun. 15, 1993

[54] APPARATUS FOR OPENING AND CLOSING BIN LID FROM BELOW

[75] Inventor: Eugene B. Pollock, Shelby County, Ill.

[73] Assignee: Grain Systems, Inc., Assumption, Ill.

[21] Appl. No.: 811,615

[22] Filed: Dec. 23, 1991

[51] Int. Cl.[5] ..... E05F 11/04

[52] U.S. Cl. ..... 49/279; 49/301; 49/302; 49/347; 49/357; 49/386; 49/394; 52/192; 220/264; 220/326

[58] Field of Search ..... 49/279, 293, 297, 301, 49/302, 357, 347, 394, 386; 220/262, 263, 264, 326; 52/192

[56] References Cited

U.S. PATENT DOCUMENTS

| | | | |
|---|---|---|---|
| 4,208,839 | 6/1980 | Candy, Sr. | 49/357 X |
| 4,327,522 | 5/1982 | Meadows | 49/279 |
| 4,598,496 | 7/1986 | Van Daele | 49/357 |
| 4,744,183 | 5/1988 | Kruger | 49/357 X |
| 4,747,244 | 5/1988 | Christianson | 49/357 X |

FOREIGN PATENT DOCUMENTS

| | | | |
|---|---|---|---|
| 28392 | of 1910 | United Kingdom | 49/301 |

OTHER PUBLICATIONS

"BFT Series . . . Erection Manual" Grain Systems, pp. 7-10.

GSI Rigid Ground Control General Overview, pp. 1-5.

*Primary Examiner*—Philip C. Kannan

*Attorney, Agent, or Firm*—Polster, Lieder, Woodruff & Lucchesi

[57] ABSTRACT

An apparatus for opening and closing a top bin lid from below such that, when in the fully opened position, the lid will not extend above the plane of the opening. The apparatus utilizes an elongated lever arm pivotally mounted on the pivot axis of the bin lid. A flexible linkage, such as a chain extends from below, over the lever arm and is connected to a gravity biased latch system which holds the lid in the closed position until the chain is pulled from below. After the latch is released, further drawing of the chain will pivot the lid and arm about their common pivot axis until the arm is obstructed from further movement by the bin. Continued pulling of the chain will draw the lid toward the lever arm against spring pressure until the lid has been pivoted approximately 180° from its closed position. Controlled release of the chain will cause the spring pressure to move the lid over the vertical plane of the pivot axis and thereafter the force of the spring and gravity will return the lid and latch back to the closed position. The lever arm includes a lid engagement tab which returns the lever arm to its upwardly extending position when the lid closes.

22 Claims, 4 Drawing Sheets

APPARATUS FOR OPENING AND CLOSING BIN LID FROM BELOW

BACKGROUND OF THE INVENTION

The present invention relates to an apparatus for opening and closing a bin lid from below. Bins utilized on farms and in industry for storing grain or other aggregate materials are most often much taller than a man. Consequently, in the past a man was required to climb a ladder to the top of the bin in order to reach and open or close a top bin lid. The opening in the top of the bin which is closed by the bin lid is usually utilized for loading material into the bin and/or gaining access to the interior of the bin.

Requiring a man to climb to the top of a bin in order to open or close a bin lid is both inefficient and somewhat dangerous. It has been recognized in the art that a ground controlled bin lid opening and closing apparatus would eliminate the above-mentioned inefficiency and danger. One prior art scheme provided a series of rigid mechanical linkages pivotally assembled and extending from the bin lid to within reach of a man on the ground. One problem encountered with this prior art design is that the bin lid when opened was pivoted only 90° and thus would stick straight up in the air. This position may cause problems when equipment such as a feed truck with an auger or other portable conveying equipment is attempted to be positioned over the top loading opening and collisions between the loading equipment and the bin lid were not uncommon, sometimes causing damage to the bin lid, the bin lid linkage, or the loading equipment.

In another assembly produced by the assignee herein, a bin lid which is pivotally mounted about a first pivot axis over the top opening is spring-biased to the closed position by a first spring. A lever arm mounted to the top of the bin lid on a second pivot axis is also spring-biased by a second spring to a position extending upwardly with respect to the lid. A chain extending from the ground, is threaded over a pulley on a lever arm to the side of the lid opposite the pivot axis. When pulled, the chain caused the lever arm to move downwardly and the lid to pivot about the first axis towards an open position against the bias of the first spring. Once the lever arm reached its downward limit of travel, continued pulling of the chain would cause the lid to start pivoting about the second pivot axis such that the bin lid would move toward the lever arm against the bias of the second spring. In this manner the bin lid was able to pivot approximately 180° from the closed position and be completely removed from above the plane of the bin opening, greatly lessening the chances of collision between the lid assembly and bin loading equipment. When the chain was released, the spring bias of the first spring would return the lid to the closed position and the spring bias of the second spring would return the lever arm to its original position.

One drawback of this apparatus is that it is relatively expensive, requiring an undue number of pivot brackets, springs, etc. Another drawback is that the optimal spring for biasing the lid closed and conveniently allowing a man to pull against the spring bias is not sufficiently strong to hold the lid closed during high wind conditions. Another problem encountered is that during assembly of the lid on the bin loading opening coaming, the assembler must bolt the lid to the coaming while various parts of the lid were under a strong spring bias in a direction away from the position in which it is to be secured.

SUMMARY OF THE INVENTION

It is therefore an object of the present invention to provide an apparatus for opening and closing a bin lid from below which pivots the bin lid approximately 180° from the closed position to reduce the chance of collision of the lid apparatus with other equipment such as bin loading equipment and which requires fewer parts and is relatively less expensive.

It is another object of the invention to provide a bin lid opening and closing apparatus as stated above which includes an inexpensive positive latch closure which is also operated from below.

It is a still further object of the invention to provide a bin lid opening and closing apparatus which is easier and safer to install and folds into a compact position for shipment.

Generally speaking, the apparatus for opening and closing a bin lid comprises a lid assembly pivotally mounted about a fixed pivot axis for pivotal movement between a fully closed position and a fully open position.

An elongated lever arm is pivotally mounted about the same pivot axis adjacent one end of the lid. The lever arm has an opposite end extending upwardly with respect to the lid when the lid is in the closed position. An elongated flexible linkage means such as a chain has a first end attached to the lid, an intermediate portion threadingly engaging the upper end of the lever arm, and a control end positioned near the ground. The lid includes a latch means located on a side of the lid opposite the fixed pivot axis of the lid for automatically mechanically latching the lid closed when the lid is in the closed position. The linkage means is attached to the latch mechanism such that initial pulling of the control end of the linkage means first unlatches the latch means and thereafter additional pulling of the linkage means opens the lid. Also, only a single biasing means such as a spring is mounted around the single fixed pivot axis to return the lid from the fully opened position to a position where the force of the spring and gravity will pull the lid fully closed.

These as well as other objects and advantages will become more apparent upon a reading of the following detailed description of the preferred embodiment in conjunction with the drawings wherein:

DETAILED DESCRIPTION OF THE PREFERRED EMBODIMENT

Figure 1:
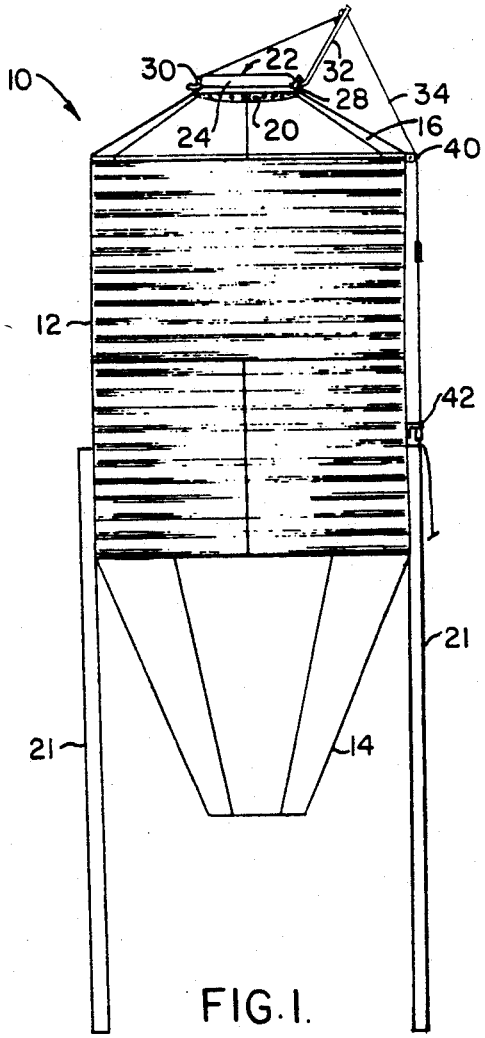
FIG. 1 is a side elevation of a farm hopper-type holding bin including an apparatus for opening and closing the bin lid from below showing the bin lid in the fully closed position.
Figure 2:
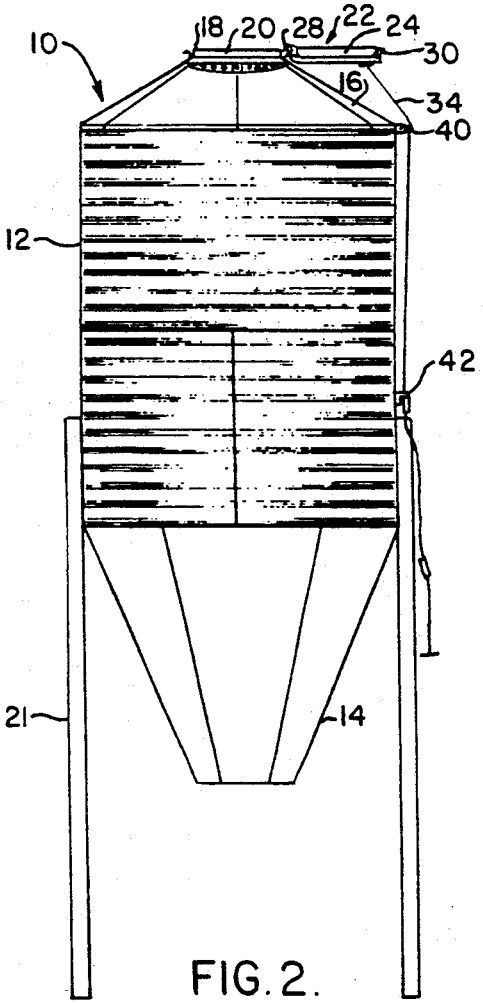
FIG. 2 is a side elevation similar to FIG. 1 except showing the bin lid in the fully opened position.

With reference to the drawings and FIGS. 1 and 2 in particular, there is shown a farm hopper-type holding tank or bin generally indicated by the reference numeral 10. Bin 10 may be any type of bin or tank for the holding or storage of farm grains, feed, fertilizer, etc. or for the storage of other aggregates or even liquids in a farm or industrial environment. The present invention would be useful on any tall bin, tank or other structure where a top opening is beyond the reach of an operator standing on the ground, or on a structure in which the top opening is otherwise inaccessible.

Bin 10 includes a generally cylindrical wall 12, a funnel shaped hopper outlet portion 14 and a sloping roof portion 16 provided with a central circular loading opening 18 defined by annular coaming 20. Outlet portion 14 is elevated above the ground by support legs 21 which in combination with the additional height of wall 12 elevates the top opening 18 far above the reach of a man standing on the ground.

Figure 3:
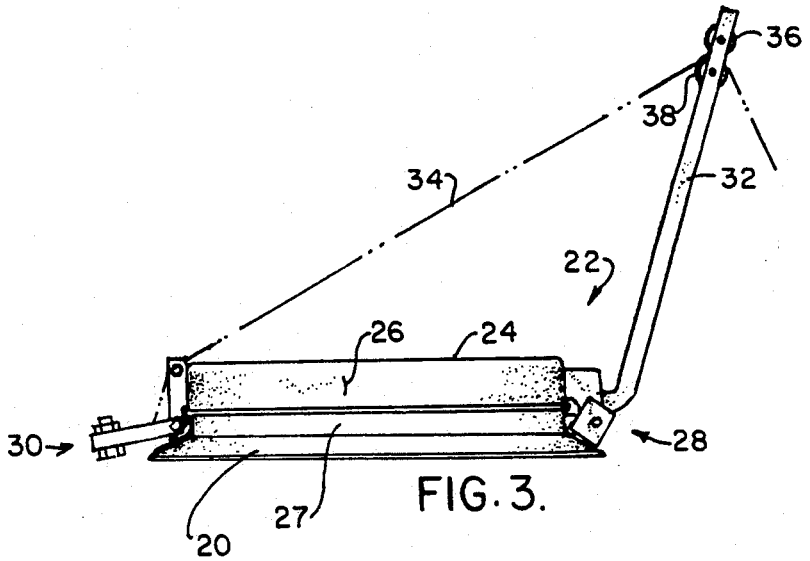
FIG. 3 is an enlarged side elevation of the bin lid apparatus per se with the bin lid in the fully closed position.

Mounted over top opening 18 and upon coaming 20 is bin lid assembly 22, as best seen in FIG. 3. Bin lid assembly 22 includes a circular bin lid 24 having a depending annular skirt portion 26 which when in the closed position surrounds an annular upstanding wall portion 27 of coaming 20. Lid assembly 22 also includes on one side thereof a hinge assembly 28, and on a diametrically opposite side thereof a latch assembly 30. Pivotally mounted on the same pivot axis with lid 24 is a lever arm 32. A flexible linkage means 34 such as a rope, but preferably a chain, is connected at one end to latch assembly 30, extends to the upper end portion of lever arm 32 where it is threaded through arm 32 and between upper pulley 36 and lower pulley 38, which are rotationally mounted to lever arm 32; whereafter chain 34 projects downwardly through bin side guide 40 toward the ground. If a rope is used instead of chain 34, pulleys 36 and 38 may be replaced with stationary plastic guides (not shown).

Figure 17:
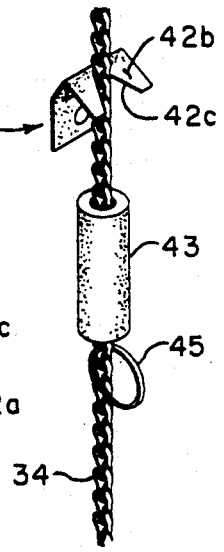
FIG. 17 is a perspective view of a preferred chain securing bracket which may be mounted on a lower easily accessible area of the bin structure.

A chain holding bracket 42 is mounted to the side of bin 10 to selectively secure chain 34. As shown in FIG. 17, bracket 42 includes an outwardly extending leg 42*b* having a V-shaped notch 42*c*. A bushing 43 rides on chain 34 and is positionally supported by a ring 45. The engagement of bushing 44 will hold the lid 24 open, as is described below.

Figure 16:
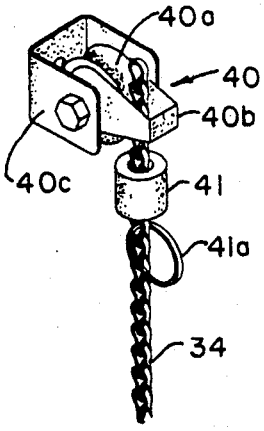
FIG. 16 is a perspective view of a preferred chain pulley per se which may be mounted on an upper corner of the bin wall.
Figure 9:
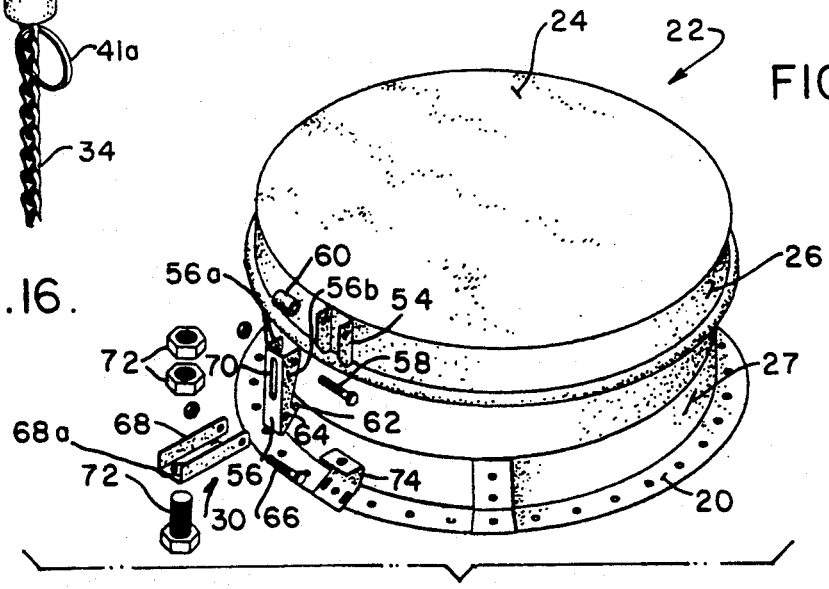
FIG. 9 is an exploded perspective showing the latch mechanism.

Pulley guide 40 is positioned upwardly of bracket 42 as shown in FIGS. 1 and 2. As shown in FIG. 16, guide 40 includes pulley 40*a* surrounded by a pulley bracket 40*b* both of which are carried by a bracket 40*c*. Chain 34 passes between pulley 40*c* and pulley bracket 40*b* and carries a bushing 41 which is positionally supported by a ring 41*a*. As lid 24 is closed, bushing 41 will butt against bracket 40*a* to prevent further travel of chain 34.

Figure 4:
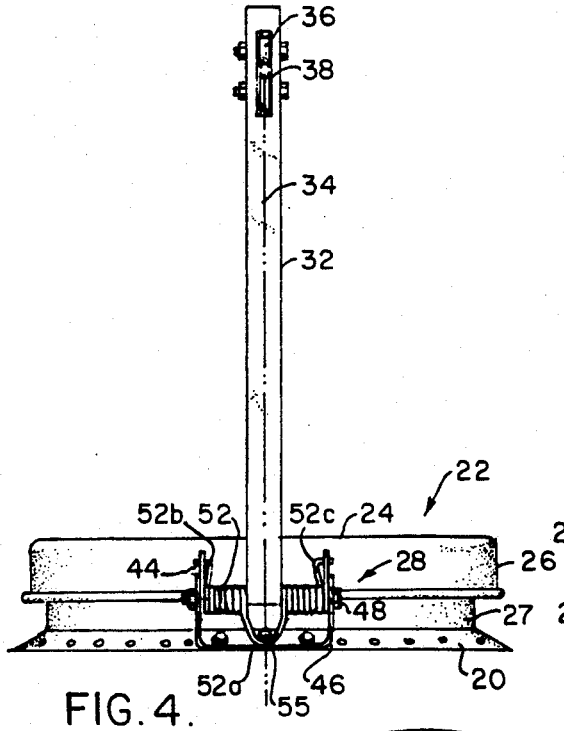
FIG. 4 is a rear elevation of the bin lid apparatus with the bin lid in the fully closed position.
Figure 5:
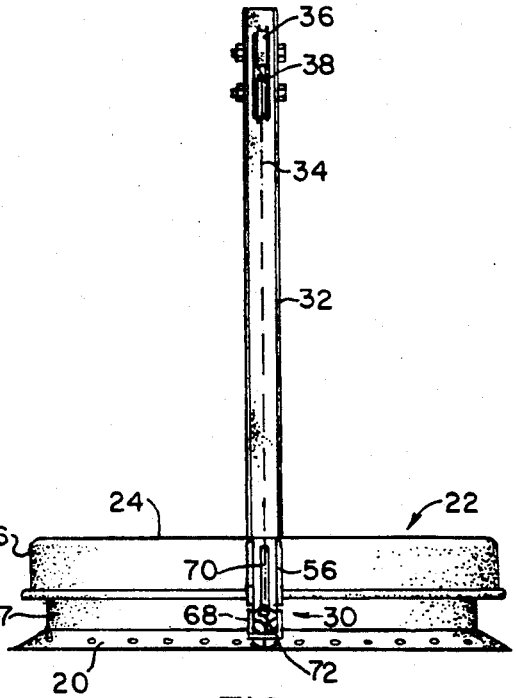
FIG. 5 is a front elevation of the bin lid apparatus with the bin lid in the fully closed position.
Figure 6:
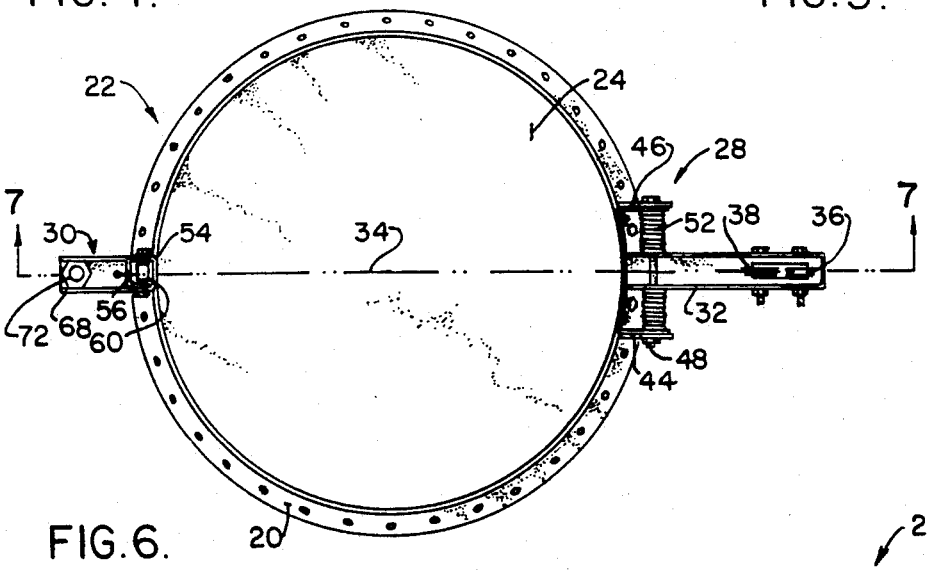
FIG. 6 is a top plan view of the bin lid apparatus with the bin lid in the fully closed position.
Figure 7:
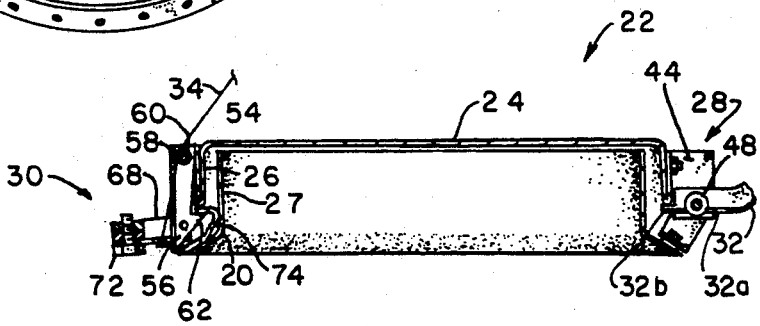
FIG. 7 is a partial cross section of the bin lid apparatus taken along reference line 7—7 of FIG. 6.
Figure 8:
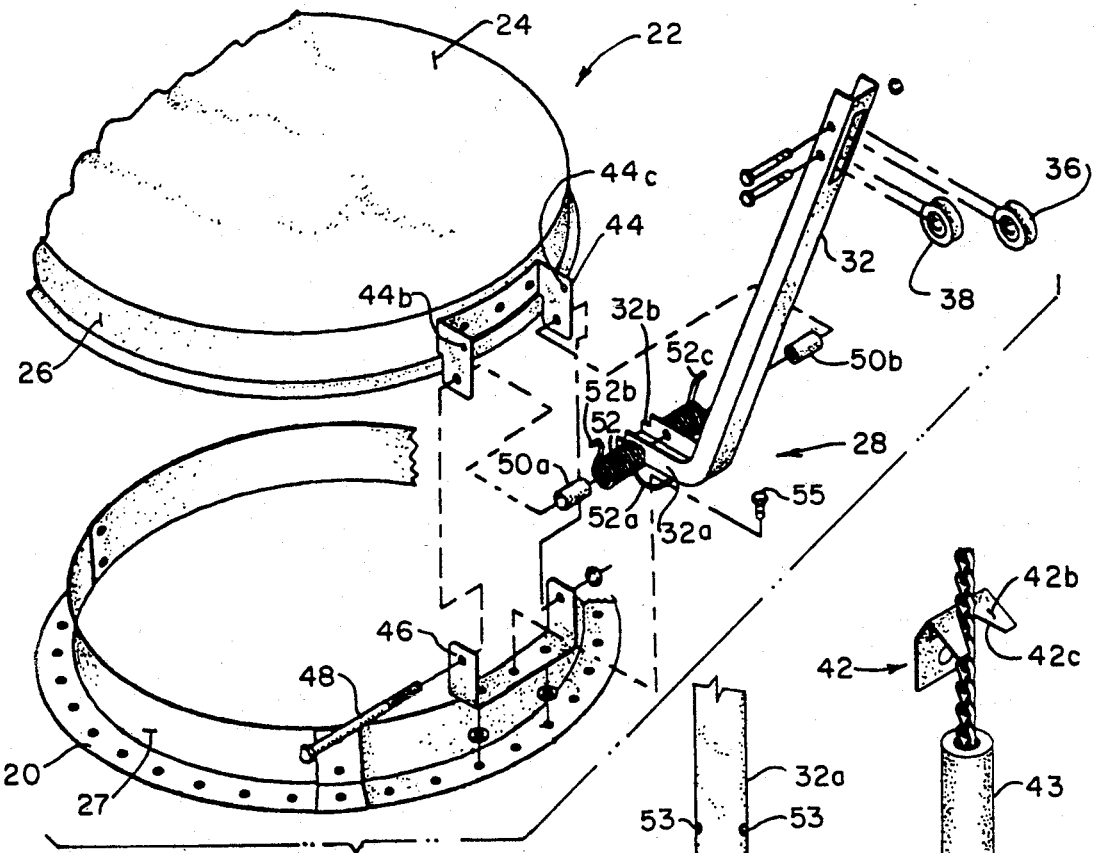
FIG. 8 is an exploded perspective of the bin lid apparatus showing the single pivot axis.
Figure 8A:
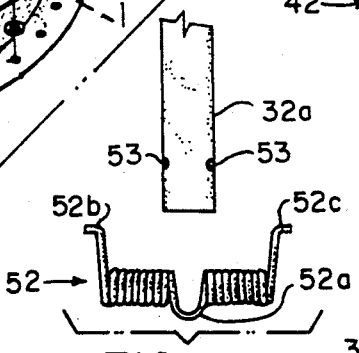
FIG. 8A is an exploded elevational view of the spring and lever.

With particular reference to FIGS. 4, 6 and 8, the structure of hinge assembly 28 will now be described. Hinge assembly 28 includes a top, generally U-shaped bracket 44 permanently affixed to skirt portion 26 of lid 24, and a bottom, generally U-shaped bracket 46 bolted to coaming 20. A the length of the central body portion of bottom bracket 46 is slightly larger than that of top bracket 44, the legs of the brackets nest together and are pivotal with respect to each other along a horizontal axis defined by pivot pin 48 which passes through aligned holes in each of the legs of brackets 44 and 46. Also mounted upon pivot pin 48 within the legs of bracket 44 are a pair of bushings 50*a*, 50*b*, double coil spring 52 coaxially positioned on bushings 50*a*, 50*b*, and the bottom portion 32*a* of lever arm 32 centrally positioned between the connected coils of double coil torsion spring 52. Double coil spring 52 includes a central U-shaped bridge portion 52*a* and a pair of laterally spaced free ends 52*b*, 52*c* which are received in respective holes 44*b*, 44*c* of top bracket 44, as shown in FIG. 8. The side portions of spring bridge 52*a* engage notches 53 (FIG. 8A) formed in the sides of lever arm lower portion 32*a*. Spring bridge portion 52*a* bears against a bolt 55 when the lid is in a closed position. It can therefore be seen that spring 52 will urge lid 24 to pivot about bolt 48 away from the major extent of lever arm 32 when lid 24 is closed and is resiliently biased toward its fully closed position, as shown in FIG. 1. Lever arm 32 also includes a stepped end 32*b* which, as best seen in FIG. 7, extends beneath the skirt 26 of lid 24 so that any closing pivoting movement of lid 24 will cause lever 32 to pivot upwardly to its starting position.

With particular reference to FIGS. 9–12, the structure of latch assembly 30 will be explained. Latch assembly 30 includes a generally U-shaped bracket 54 affixed to skirt portion 26 of lid 24, located diametrically opposite to hinge assembly 28. Bracket 54 pivotally carries a latch member 56 which is fabricated of U-shaped metal having inwardly directed legs 56*a*, 56*b* which fit within bracket 54. Bracket 54 carries horizontal pivot pin 58 about which latch member 56 pivots, and pin 58 coaxially supports bushing 60 within legs 56*a*, 56*b* of latch member 56. The inwardly facing edges of legs 56*a*, 56*b* are formed to define a hook portion 62 and a slanted camming portion 64 extending between the bottom of latch member 56 and hook portion 62. Also adjacent the bottom of latch member 56 are aligned holes which carry horizontal pivot pin 66. Pivot pin 66 pivotally holds weight member 68. Weight member 68 is another U-shaped member having legs with aligned holes for pivotal movement with latch member 56 about pivot pin 66. The central portion of latch member 56 contains elongated slot 70 through which chain 34 is threaded after being received over bushing 60. Weight member 68 extends radially away from pivot pin 66, and carries on the opposite end thereof nut and bolts assembly 72. Assembly 72 is shown as being relatively inexpensive nuts on a bolt. The purpose of assembly 72 is to provide a counterweight and can be of any structure having significant weight. Weight member 68 also includes a hole 68*a* through which chain 34 extends and beneath which chain 34 is secured to weight member 68. A catch bracket 74 is mounted to coaming 20 and cooperates with latch hook portion 62 of latch member 56 to hold lid 24 against coaming 20 when lid 24 is in the closed and latched position.

Figure 10:
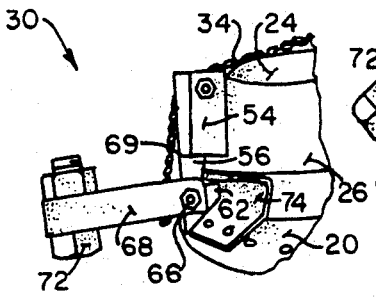
FIG. 10 is an enlarged partial side elevation showing the latch mechanism in the fully latched position.
Figure 11:
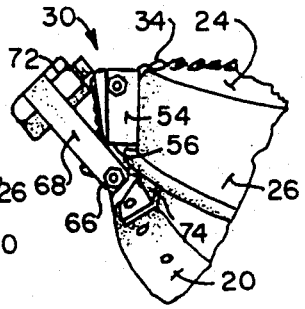
FIG. 11 is a view similar to FIG. 10 showing the latch mechanism in an intermediate opening position.
Figure 12:
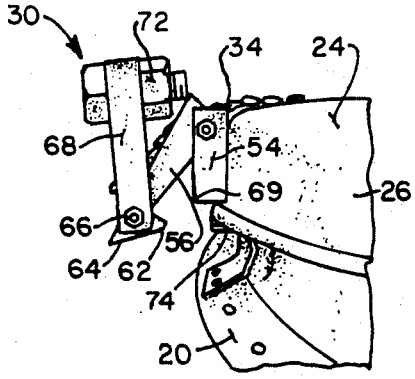
FIG. 12 is a view similar to FIGS. 10 and 11 showing the latch mechanism in the unlatched position.
Figure 13:
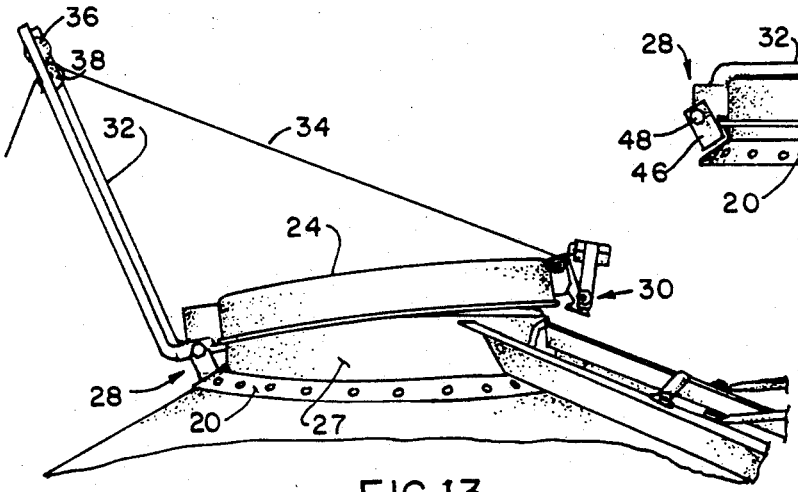
FIG. 13 is a perspective view showing the unlatched lid as it begins to be pulled open or in the last stage of closing.
Figure 14:
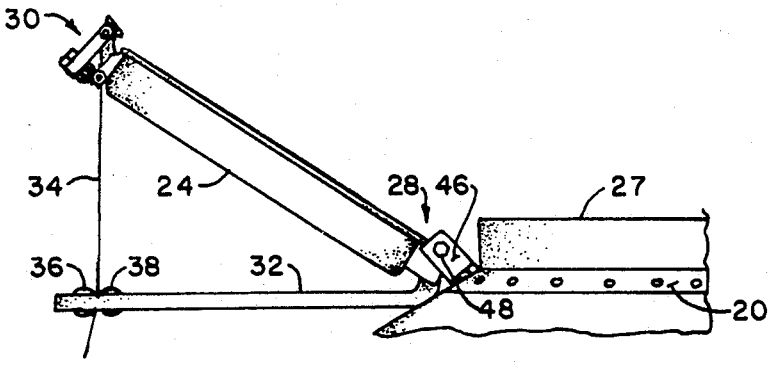
FIG. 14 is a partial side elevation of the lid apparatus in an intermediate stage of opening or closing.
Figure 15:
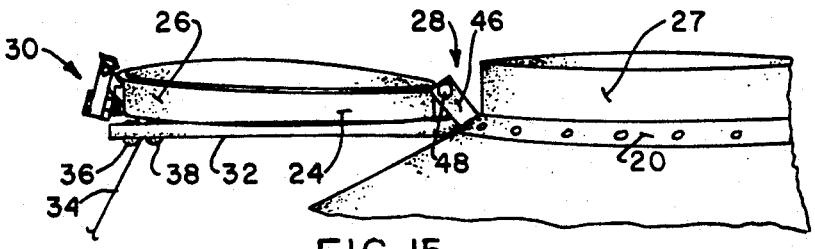
FIG. 15 is a partial side elevation of the lid apparatus in the fully opened, position.

In operation, lid assembly 22 initially is set in its fully closed, latched position, as shown in FIGS. 1 and 3. In order to open bin lid assembly 22, the operator pulls down on chain 34. The first effect from pulling chain 34 is to overcome cantilevered weight 72 on the end of weight member 68. It is noted that had it not been for weight member 68 the weight of the chain itself could have unlatched latch member 56. As weight member 68 rises, chain 34 pulls through slot 70 in latch member 56 and slides over bushing 60. After weight member 68 has pivoted upwardly against latch member 56 (as shown in FIG. 11) further pulling of chain 34 acts to cammingly pivot latch member 56 away from catch 74 on coaming 20. This camming action results from the intermediate edges of weight member 68 cammingly bearing on cam points 69 of bracket 54, as shown in FIGS. 10–12. Latch member 56 is formed such that it abuts with bracket 54 when in the unlatched position (shown in FIG. 12) and further pulling of chain 34 will now act to begin to open bin lid 24 as shown in FIG. 13. As chain 34 is further pulled, the force of chain 34 on pulley 38 causes the lever arm 32 and the lid 24 to rotate as a unit about bolt 48 so as to begin to open lid 24, as shown in FIG. 13. The stepped end 32*b* of arm 32 abuts the underside of lid 24 and maintains the angle between lever arm 32 and lid 24 until lid 24 is generally vertical and lever arm 32 is generally horizontal. Rotation of lever 32 continues until lever 32 abuts the top of bin 10, as shown in FIG. 14. Thereafter, continued pulling of chain 34 begins to pivot lid 24 with respect to lever arm 32 against the force of spring 52. Additional pulling of chain 34 may now bring lid 24 down onto horizontally positioned lever arm 32 to its fully opened position (as shown in FIG. 15) such that lid 24 has pivoted approximately 180° from its original closed position. It will be noted that with lid 24 in its fully opened position that it is at or below the horizontal plane of coaming 27 so as to not interfere with any loading equipment for filling the bin. At this point the operator may secure chain 34 on holding bracket 42 on the side of bin 10.

To close the lid, the operator slowly releases chain 34. First spring 52 will cause lid 24 to move away from lever arm 32 to a point over center; i.e., over 90° back toward the closed position, and will continue to move the lid towards its closed position, aided by gravity. When step portion 32*b* of lever arm 32 abuts lid 24, lever arm 32 will begin to pivot with lid 24 toward its initial upwardly extending position. Over-travel of lever arm 32, i.e. beyond its vertical point, is controlled by the engagement of bridge 52*a* of spring 52 with notches 53 of lever portion 32*a*. When the lid is almost closed, camming surface 64 of latch member 56 abuts catch 74 and moves latch member 56 outwardly in case chain 34 has slackened. Hook portion 62 of latch member 56 will engage catch 74 and thereafter weight member 68 will pivot downwardly to provide a secure engagement between latch member 56 and catch 74, thereby locking lid 24 closed.

Figure 18:
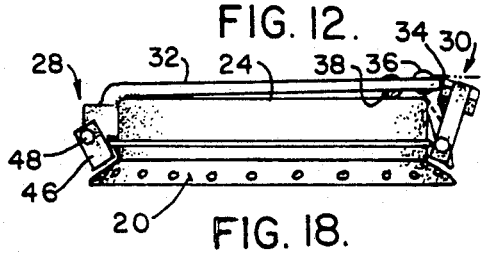
FIG. 18 is a side elevational view of the bin lid shown in a compact shipping position.

FIG. 18 shows that the assembly is well adapted for compact shipping. During shipping, chain 34 is pulled toward latch member 30 drawing lever arm 32 downward toward lid 24 against the spring pressure of spring 52. When lever arm 32 is positioned adjacent lid 24, the chain is secured and the assembly is compacted for shipment allowing for assembly of all but the coaming 20 and its catch 74.

It is noted that in some prior art assemblies an assembler would have to secure a bracket such as bracket 46 to the coaming 20 while the bracket was under substantial spring pressure. According to the present invention with the lever 32 in its folded, shipping position, this is not the case, inasmuch as spring 52 is under relatively little torsion (as compared to its operational torsion) thus allowing bracket 46 to mate up with coaming 20 and the upper edge of the roof panels. This allows bracket 46 to rotate substantially freely on bolt 48 thus permitting three bolts to be inserted through holes (unnumbered) in the base of bracket 46 (shown in FIG. 8) and to matching holes in the upper edges of the roof panels substantially without necessatating overcoming of the operation torsion of spring 52.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

I claim:

1. An apparatus for opening and closing a bin lid comprising:

a lid pivotally mounted about a fixed pivot axis adjacent an opening for pivotal movement between a fully closed position and a fully open position;

an elongated lever arm pivotally mounted adjacent said opening about a fixed pivot axis located at one end of said arm, and said lever arm having an opposite end extending upwardly with respect to said lid when said lid is in said closed position;

elongated flexible linkage means having a first end attached to said lid, an intermediate portion threadingly engaging said lever arm adjacent said opposite end, and a control end opposite said first end;

said lid including a latch means located on a side of said lid opposite said fixed pivot axis of said lid for automatically mechanically latching said lid closed when said lid is in said closed position; and said linkage means being attached to said latch mechanism such that initial pulling of said control end of said linkage means first unlatches said latch means and thereafter additional pulling of said linkage means opens said lid.

2. The apparatus as specified in claim 1 and further comprising:

said latch means being retained in a latching position by the force of gravity.

3. The apparatus as specified in claim 1 and further comprising:

said latch means includes a latch assembly on said lid;

said latch assembly including a latch member having an upper end pivotally mounted with respect to said lid and a lower hook end adapted to hook onto a catch member on the bin;

said latch member having a cam surface for automatically pivoting said hook end over the catch member as said lid is being closed; and said latch member being weighted such that the force of gravity urges said latch member toward a position where said latch member hooks onto the catch member.

4. The apparatus as specified in claim 3 and further comprising:

a cantilevered weight member pivotally mounted to said latch member and extending outwardly away from said lid to force said latch member toward the catch by the force of gravity;

said linkage means being connected to said weight member; and said weight member having sufficient weight to counteract the weight of said linkage means and thereby prevent the weight of said linkage means from unlatching said latch member.

5. The apparatus as specified in claim 4 and further comprising:

said linkage means being threaded over the pivot axis of said latch member; and means for retaining said linkage means over said pivot axis.

6. The apparatus as specified in claim 5 and further comprising:

said linkage means being a chain.

7. The apparatus as specified in claim 5 and further comprising:

pulley means coaxially mounted on the pivotal axis of said latch member.

8. An apparatus for opening and closing a bin lid on a bin or the like comprising:

a lid pivotally mounted about a fixed pivot axis for pivotal movement between a fully closed position and a fully open position, said fully open position being approximately 180° from said fully closed position;

an elongated lever arm pivotally mounted about said fixed pivot axis adjacent one end thereof, and having an opposite end extending upwardly above said lid when said lid is in said closed position;

elongated flexible linkage means having a first end attached to said lid, an intermediate portion threadingly engaging said lever arm adjacent said opposite end, and a control end opposite said first end, wherein a pulling force on said control end causes said lid to move toward said open position; and means for returning said lid from said fully open position to at least a position where the force of gravity will pull said lid to said fully closed position upon the release of such pulling force.

9. The apparatus as specified in claim 8 and further comprising:

said means for returning said lid is a spring.

10. The apparatus as specified in claim 9 and further comprising:

said spring is a coil spring, the coils of which extend around said pivot axis.

11. The apparatus as specified in claim 8 and further comprising:

said lever arm includes an approximately ninety degree bend to permit the major extent of said arm to be positioned adjacent the top surface of said lid when said lid is in the fully open position.

12. The apparatus as specified in claim 8 and further comprising:

said lever arm including lid engagement means adjacent said one end for engaging said lid and positioning said lever arm in an upward position when said lid is in said closed position.

13. The apparatus as specified in claim 8 and further comprising:

a pair of pulleys mounted on said lever arm adjacent said opposite end; and said linkage means being threaded between said pulleys.

14. The apparatus as specified in claim 8 and further comprising:

said lid including a latch means located on a side of said lid opposite said fixed pivot axis of said lid for automatically mechanically latching said lid closed when said lid is in said closed position.

15. The apparatus as specified in claim 14 and further comprising:

said latch means being retained in a latching position by the force of gravity.

16. The apparatus as specified in claim 15 and further comprising:

said latch means includes a latch assembly on said lid;

said latch assembly including a latch member having an upper end pivotally mounted with respect to said lid and a lower hook end adapted to hook onto a catch member on the bin;

said latch member having a cam surface for automatically pivoting said hook end over the catch member as said lid is being closed; and said latch member being weighted such that the force of gravity urges said latch member toward a position where said latch member hooks onto the catch member.

17. The apparatus as specified in claim 16 and further comprising:

a cantilevered weight member pivotally mounted to said latch member and extending outwardly away from said lid to force said latch member toward the catch by the force of gravity;

said linkage means being connected to said weight member; and said weight member having sufficient weight to counteract the weight of said linkage means and thereby prevent the weight of said linkage means from unlatching said latch member.

18. The apparatus as specified in claim 17 and further comprising:

said linkage means being threaded over the pivot axis of said latch member; and means for retaining said linkage means over said pivot axis.

19. The apparatus as specified in claim 18 and further comprising:

said linkage means being a chain.

20. The apparatus as specified in claim 18 and further comprising:

pulley means coaxially mounted on the pivotal axis of said latch member.

21. The apparatus as specified in claim 8 wherein said means for returning said lid from its said fully open position comprises a torsion coil spring mounted on said fixed pivot axis for resiliently biasing said lid toward its said fully closed position, said one end of said lever arm being engageable with said lid, upon pulling of said flexible linkage means said lid and said lever arm are rotatable substantially together as a unit as said lid rotates from its fully closed position to an intermediate open position at which point said lever arm engages said bin, upon continued pulling of said flexible linkage means said lid continues to rotate about said fixed pivot axis relative to said lever arm toward its fully open position, said spring having a portion thereof fixed relative to said lid and another portion thereof bearing on said bin, with said lid in its fully closed position said lever being rotatable about said fixed pivot axis relative to said lid such that said lever arm is folded over on said lid in a shipping position whereby with said lever arm restrained in its said shipping position, the torsion of said spring relative to said bin is substantially relaxed thereby to facilitate installation of said lid on said bin.

22. The apparatus as specified in claim 8 wherein said means for returning said lid from its said fully open position comprises a torsion coil spring mounted on said fixed pivot axis for resiliently biasing said lid toward its said fully closed position, said one end of said lever arm being engageable with said lid, upon pulling of said flexible linkage means said lid and said lever arm are rotatable substantially together as a unit as said lid rotates from its fully closed position to an intermediate open position at which point said lever arm engages said bin, upon continued pulling of said flexible linkage means said lid continues to rotate about said fixed pivot axis relative to said lever arm toward its fully open position, said spring having a portion thereof fixed relative to said lid and another portion thereof bearing on said bin, said spring being engageable with a portion of said lever arm when the latter is in a normal generally upright position when said lid is in its fully close position thereby to insure that upon applying tension to said flexible linkage said lever arm will cooperate with said lid to open the lid, said bridge portion of said spring preventing over travel of said lever arm beyond its said normal upright position upon closing of said lid.

* * * * *